United States Patent [19]

Inoue

[11] Patent Number: 4,853,584

[45] Date of Patent: Aug. 1, 1989

[54] CATHODE-GRID SUPPORT STRUCTURE FOR CRT ELECTRON GUN

[75] Inventor: Hirom Inoue, Tokyo, Japan

[73] Assignee: Sony Corporation, Tokyo, Japan

[21] Appl. No.: 88,155

[22] Filed: Aug. 21, 1987

[30] Foreign Application Priority Data

Aug. 21, 1986 [JP] Japan ..... 61-196013

[51] Int. Cl.[4] ..... H01J 29/04; H01J 29/50; H01J 29/82

[52] U.S. Cl. ..... 313/417; 313/447; 313/457

[58] Field of Search ..... 313/446, 447, 457, 417

[56] References Cited

U.S. PATENT DOCUMENTS 3,230,600 1/1966 Barnes .
3,426,413 2/1969 Griffiths .
4,376,257 3/1983 Miyazaki et al. ..... 313/457 X

FOREIGN PATENT DOCUMENTS 0019975 12/1980 European Pat. Off. .
2503144 7/1975 Fed. Rep. of Germany ..... 313/446
1789188 2/1977 Fed. Rep. of Germany ..... 313/446
2008851 11/1977 United Kingdom .
1494022 12/1977 United Kingdom .
2057755 8/1979 United Kingdom .

*Primary Examiner*—Palmer C. DeMeo

[57] ABSTRACT

An electron gun with an improved structure for providing accurately adjusted cut-off voltage. A novel process for producing the improved electron gun, and maintain substantially high uniformity of cut-off voltge in production. The electron gun comprises a plurality of grid electrodes including a first electrode mounted at the closest position to a cathode. The cathode is supported by a cathode base. The cathode base and the first electrode are provided in a pre-assembled form. The pre-assembly of the cathode base and the first electrode is supported by means of a holder which is fixed to glass beads together with other grid electrodes. In assembling of the electron gun, the distance between the cathode surface of the cathode and a plane surface of the first grid electrode, where an electron beam path is defined, is precisely adjusted during formation of the pre-assembly. The holder and the grid electrodes other than the first grid electrodes are subjected to a beading process so as to mount them on the glass beads with known spacings. After the beading process, the pre-assembly of the cathode base and the first grid electrode is mounted to the holder and the distance between the first and second grid electrodes is adjusted to a given distance.

3 Claims, 4 Drawing Sheets

CATHODE-GRID SUPPORT STRUCTURE FOR CRT ELECTRON GUN

BACKGROUND OF THE INVENTION

1. Field of the Invention

The present invention relates generally to an electron gun for a cathode ray tube to be employed such as in television sets and display monitors. More specifically, the invention relates to an electron gun which is assembled in a novel process to provide increased uniformity of cut-off voltage.

2. Description of the Background Art

As is well known, electron guns comprise a plurality of grids arranged in alignment along their axes at predetermined intervals. The cut-off voltage $E_{KCO}$ of such electron guns can be determined according to the following formula:

$$E_{KCO} \frac{1}{d_{01}d_{12}} 0.5$$

where $d_{01}$ is the distance between a cathode K and a first grid electrode which is the closest grid electrode to the cathode; and $d_{12}$ is the distance between the first grid electrode and the second grid electrode which is located adjacent the first grid electrode.

As will be appreciated, when assembling electron guns the aforementioned $d_{01}$ and $d_{12}$ distances must be maintained accurately in order to obtain high uniformity of the cut-off voltage $E_{KCO}$. It is especially essential to precisely maintain the predetermined distance between the cathode and the first grid electrode.

In conventional assembly processes for assembling electron guns, mounting pins are provided for respective grid electrodes at radially symmetrical positions or integrally formed projections are provided projecting from the outer periphery of the grid electrode at radially symmetrical orientations. The mounting pins and projections are buried in a pair of glass beads which are located at respective axial positions while predetermined distances are maintained between the grid electrodes. The glass beads thus maintain the distance between the grid electrodes as they are assembled. After forming the aforementioned assembly of the grid electrodes and the glass beads, a cathode base with cathode or cathodes is mounted on the first grid electrode with a predetermined spacing to the latter maintained by means of an appropriate spacer. Then, the distance between the plane of the first grid electrode, in which an electron beam path in the form of a through opening is defined, and the mating end of the cathode is adjusted while monitoring the $d_{01}$ distance by means of an airmicrometer.

In the foregoing conventional process, spacers defining the predetermined distances between grid electrodes are inserted between respective grid electrodes for defining the distance between the respectively adjacent grid electrodes upon forming the assembly of the glass beads and the grid electrodes. The grid electrodes and the spacers are held tightly in their assembled positions by means or a jig. At this position, the glass beads are opposed to the mounting pins or projections at radially symmetrical positions. Then, the glass beads are heated and depressed so as to bury the mounting pins or the projections. In this way the grid electrodes are mechanically connected via the glass beads. In this process, the distance between the first and second grid electrodes are adjusted to the predetermined distance in order to obtain the predetermined cut-off voltage. However, in practice, since the first and second electrodes are depressed during the beading process the distance therebetween is altered during the process. Therefore, in production, uniformity of the cut-off voltage of the electron guns has been difficult to obtain.

In another process, the dimension $(d_{01}+d_{12})$ between the cathode surface to the second grid electrode is measured by means of an airmicrometer inserted from the side of the second grid electrode. According to the result of this measurement, the position of the cathode base is adjusted. In this process, though the dimension $d_{01}+d_{12}$ can be adjusted in a rather precise manner, it is not possible to adjust respectively the dimensions, $d_{01}+d_{12}$, separately. As will be seen from the foregoing formula, the dimension between the cathode surface and the first grid electrode will have greater influence than that of between the first grid electrode and the second electrode. Therefore, even with this process, uniformity of the cut-off voltage cannot be obtained.

In other conventional assembly processes for assembling an electron gun, a pre-assembly of the first grid electrode and the cathode is prepared before the beading operation. During preparation of the grid/cathode pre-assembly, the distance between the cathode surface and the first grid can be precisely adjusted to the predetermined distance $d_{01}$ by utilizing the airmicrometer. The prepared grid/cathode pre-assembly is subjected to the beading process along with the other grid electrodes in substantially the same manner as that described above. In this process, the dimension $d_{01}$ can be obtained precisely in the pre-assembly process. However, the problem of deformation of the first and second grid electrodes as discussed with respect to the first process remains unsolved.

On the other hand, in recent years, the demand for fine pitch type cathode ray tubes has increased. This requires high precision adjustment of the cut-off voltage and consequently requires high production accuracy of the electron gun.

The following applications relating to electron guns are assigned to the Assignee of the present application:

1. Ser. No. 802,476, Electron Gun For a Color Display Apparatus, filed Nov. 27, 1985, Inventors: Iguchi et al;
2. Ser. No. 047,578, Electron Gun, filed May 8, 1987, Inventor: Watanabe;
3. Ser. No. 867,535, Electron Gun, filed May 28, 1986, Inventor: Yasuda; and
4. Ser. No. 826,836, Electron Gun, filed Feb. 6, 1986, Inventor: Watanabe.

SUMMARY OF THE INVENTION

Therefore, it is an object of the present invention to provide an electron gun with an improved structure for providing accurately adjusted cut-off voltage.

Another object of the invention is to provide a novel process which can maintain substantially high uniformity of cut-off voltage in production of electron guns.

In order to accomplish the mentioned and other objects, an electron gun, according to the present invention, comprises a plurality of grid electrodes including a first electrode oriented at the closest position to a cathode. The cathode is supported by a cathode base. The cathode base and the first electrode are provided in a pre-assembled form. The pre-assembly comprised of the cathode base and the first electrode is supported by means of a holder which is fixed to glass beads along with the other grid electrodes.

In the aforementioned construction technique, the pre-assembly is not subjected to the depression force which tends to cause deformation of the first grid electrode. This makes it easy to adjust the distance between the first grid electrode and a second grid electrode which is next to the first electrode.

The dimension between the cathode surface of the cathode and a plane of the first grid electrode, where an electron beam path is defined, is precisely adjusted during formation of the pre-assembly. The holder and the grid electrodes other than the first grid electrodes are mounted on the glass beads at given spacings in a beading process. After this beading process, the pre-assembly of the cathode base and the first grid electrode is attached to the holder and the distance between the first and second grid electrodes is adjusted to a given distance.

According to one aspect of the invention, an electron gun for a cathode ray tube comprises a plurality of second grid electrodes, each defining an electron beam path and having an extension extending substantially perpendicular to the axis of the electron gun, the grid electrodes being arranged with their electron beam paths aligned, a cathode/grid assembly holding a cathode in alignment with an axis extending through the electron beam path, and a first grid electrode having a plane, in which an electron beam path is defined, the cathode and the first grid electrode of the assembly are oriented to define a predetermined clearance between a top of the cathode and the plane of the first grid electrode, a holder member formed separately from the cathode/grid assembly and having an extension extending substantially perpendicular to the axis of the electron gun, the holder member being designed for fixedly mounting the cathode/grid assembly in assembled condition in such a position that the first grid electrode of the assembly is located at a position adjacent one of the second grid electrodes with a predetermined distance defined therebetween, and a glass bead receiving the extensions of the second grid electrodes and the holder member for maintaining a fixed positional relationship between the second grid electrodes and the holder member.

In practice, the cathode/grid assembly is prepared as a pre-assembly in advance of being installed on the holder which is held by the glass beads, and comprises a cathode for generating an electron beam, a cathode base supporting the cathode by means of a mounting means, and a metal stay which is fixed to the cathode base. The metal stay is rigidly fixed to the holder member by way of spot welding. By preparing the cathode/grid pre-assembly separately from the holder means and attaching the pre-assembly to the beading assembly after beading operation, the pre-assembly is not subjected to any substantial force or heat which would cause deformation thereof.

On the other hand, the holder member is preferably of generally cylindrical configuration with extensions laterally extending from at least one of the axial end edges thereof and the first grid electrode is preferably formed into an essentially cup-shaped configuration which defines therein a space for receiving the cathode base with the cathode.

According to another aspect of the invention, a process for assembling an electron gun comprising the steps of:

preparing a cathode/grid pre-assembly which includes a cathode and a first grid electrode providing a predetermined clearance between the top of the cathode and a plane of the first grid electrode mating the top of the cathode;

providing an essentially cylindrical holder member with at least one second grid electrode, the holder member and the second grid electrode are provided with lateral extensions extending from the outer peripheries thereof substantially perpendicular to the axis of the electron gun;

arranging the holder member and the second grid electrode substantially in alignment with each other at a given distance;

performing beading operation for assembling the holder member and the second electrode to glass beads to form a beading assembly; and rigidly attaching the cathode/grid assembly to the holder member while maintaining a predetermined distance between the first and second electrodes.

In the process set forth above, the step of preparing cathode/grid pre-assembly includes a step for fixing the positional relationship between the first grid electrode and the cathode base, and a step for adjusting the position of the cathode relative to the first grid electrode for defining the clearance between the top of the cathode and the plane of the first grid electrode. In practice, the step for adjusting the position of the cathode follows the step for fixing the positional relationship between the first electrode and the cathode base. On the other hand, the step of assembling the cathode/grid pre-assembly to the holder means follows the step of performing the beading operation for forming the beading assembly.

According to a further aspect of the invention, a method is disclosed for adjusting clearance between first and second grid electrodes and between a cathode surface of a cathode and the first electrode, in a process for assembling an electron gun which comprises the cathode, a plurality of grid electrodes including the first and second grid electrodes, and a cathode base holding the cathode, comprises the steps of:

fixing the positional relationship between the cathode base and the first grid electrode by rigidly fixing the cathode base and the first grid electrode;

adjusting the position of the cathode relative to the cathode base for defining a first given clearance between the cathode surface and a first plane of the first grid electrode;

fixing the positional relationship between the cathode and the cathode base at an adjusted position for establishing a first assembly of the cathode, cathode base and the first grid electrode in fixed positional relationship to each other;

providing a holder member;

fixing the positional relationship of the holder member and the grid electrodes excluding the first electrode for establishing a second assembly with fixed positional relationship of the holder member and the second grid electrode;

disposing the first assembly in the holder member, adjusting the positional relationship between the first assembly and the holder member for adjusting a clearance between the first and second electrodes at a given second clearance for fixing the position of the first assembly relative to the holder member.

Preferably, the step of establishing the second assembly includes the beading process.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
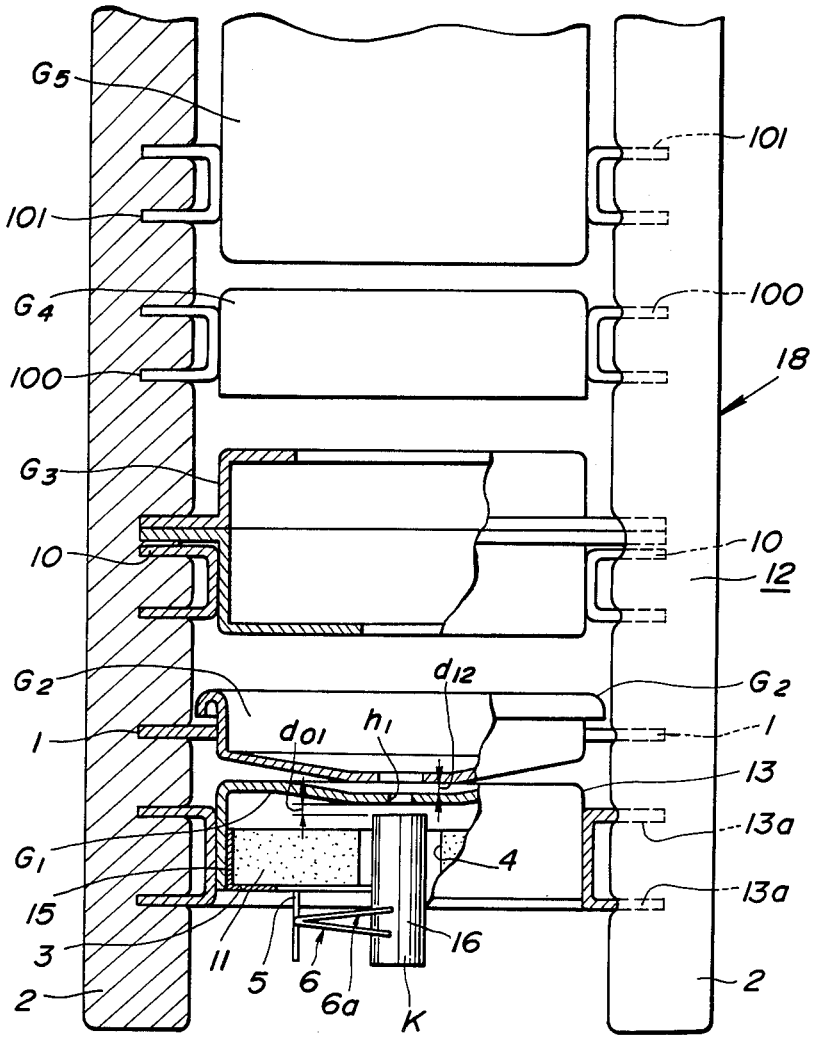
FIG. 1 is a front elevation of the preferred embodiment of an electron gun according to the invention.

Referring now to the drawings, particularly to FIG. 1, the preferred embodiment of an electron gun includes first to fifth grid electrodes $G_1$, $G_2$, $G_3$, $G_4$ and $G_5$. The first to fifth electrodes $G_1$, $G_2$, $G_3$, $G_4$, and $G_5$ are respectively formed with through openings $h_1$, $h_2$, $h_3$. . . through planar sections extending substantially perpendicular to the longitudinal axis of the electron gun. Respective first to fifth grid electrodes $G_1$, $G_2$, $G_3$, $G_4$, and $G_5$ are arranged with the axis of the through openings, $h_1$, $h_2$, $h_3$. . . in alignment with the longitudinal axis of the longitudinal axis of the electron gun.

Figure 2:
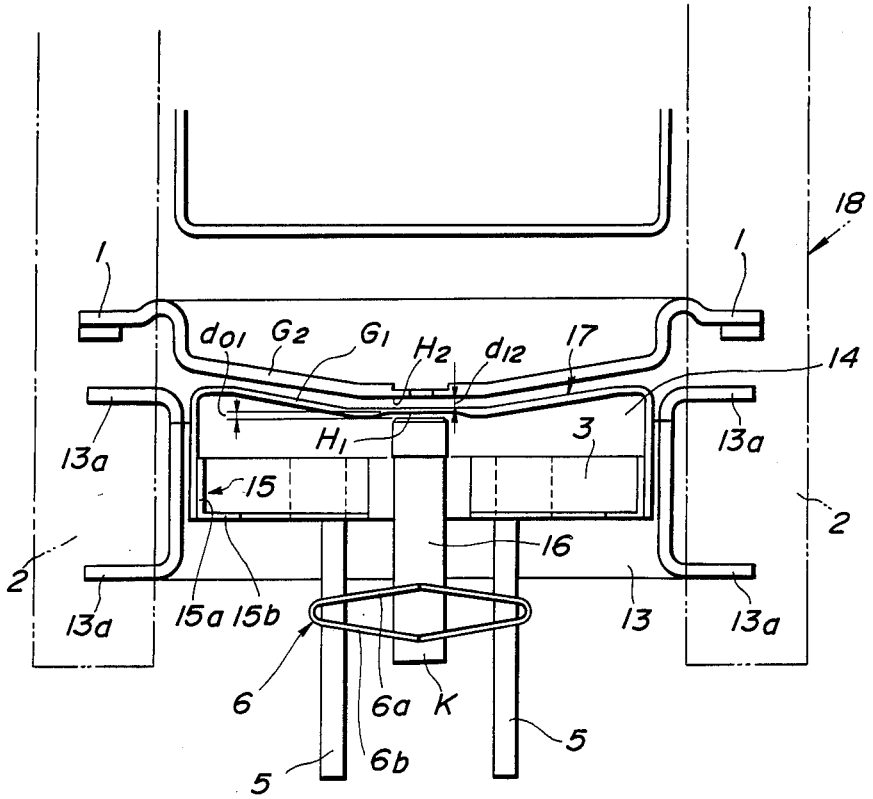
FIG. 2 is an enlarged section showing detail of mounting structure for a pre-assembly of a first grid electrode and a cathode base carrying cathodes.

A pair of mounting pins 1, 10, 100 and 101, respectively are rigidly secured on the outer periphery of each of the second to fifth grid electrodes $G_2$, $G_3$, $G_4$, and $G_5$. The mounting pins 1, 10, 100 and 101, are positioned at radially symmetrical positions and extend outwardly from the outer periphery of the associated grid electrode. The mounting pins 1, 10, 100 and 101 are buried in a pair of glass beads 2 for supporting respectively associated second to fifth grid electrodes $G_2$ to $G_5$ on the glass bead 2. On the other hand, as shown in FIG. 2, the first grid electrode $G_1$ has no mounting pin and is mounted on an annular grid holder 13. The grid holder 13 is of generally annular cylindrical configuration and has rigidly secured on the other periphery thereof mounting pins 13a at radially symmetrical positions. As are mounting pins 1, 10, 100 and 101, for the second to fifth grid electrodes $G_2$, $G_3$, $G_4$ and $G_5$, the mounting pins 13*a* are buried in the glass bead 2 so as to support the grid holder thereon.

Figure 3:
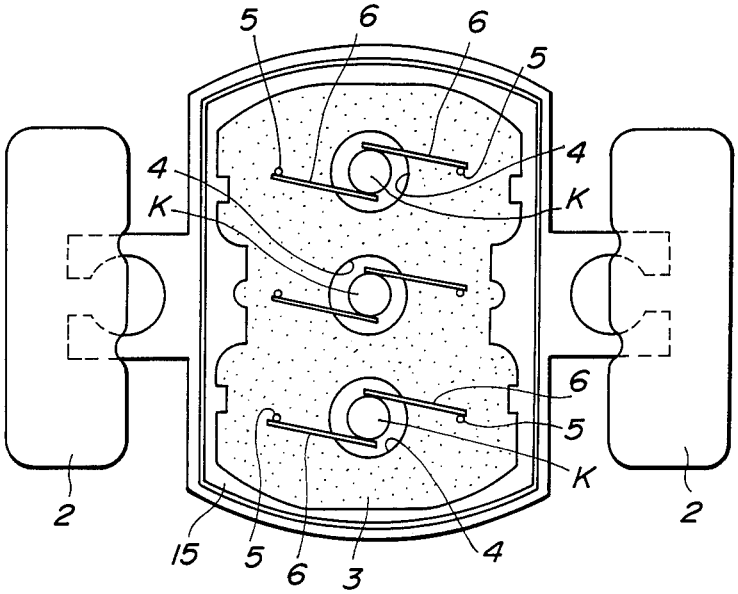
FIG. 3 is a view of the electron gun as viewed from the lower side of FIG. 1.
Figure 4:
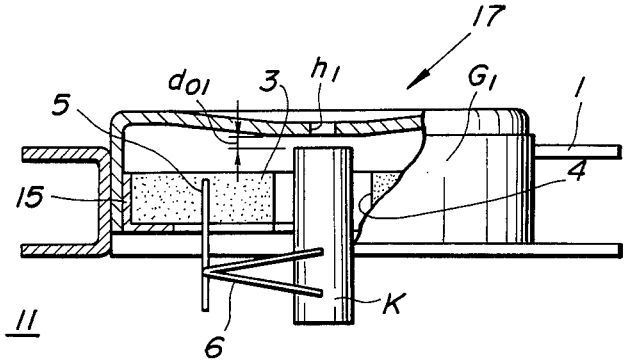
FIG. 4 is a partially sectioned front elevation of the pre-assembly of the first grid electrode and the cathode base.

As will be seen from FIGS. 2 and 4, the first grid electrode $G_1$ is of essentially cup-shape configuration and opens toward the side remote from the second grid electrode $G_2$. With this construction, the first grid electrode $G_1$ defines an internal space 14. A cathode assembly 11 is disposed within the internal space 14 of the first grid electrode $G_1$. The cathode assembly 11 comprises one or more cathodes K and a cathode base 3. The cathode base 3 is made of an insulating material and defines an axially extending hole 4 to receive the cathode K therethrough. As will be appreciated, when the electron gun is applied in a color cathode ray tube, three cathodes for generating red, blue and green electon beams are provided in the electron gun. The cathodes K are arranged in alignment, as shown in FIG. 3. The top of each cathode K is of per se well known construction of generally cylindrical configuration and has a sleeve 16 and a top coated by a known cathode material.

The cathodes K are supported on the cathode base 11 in the assembled position by means of cathode mounting pins 5 and essentially V-shaped tabs 6. As seen from FIG. 3, the cathode mounting pins 5 are arranged at radially symmetrical positions with respect to the through holes 4 and extend toward the side remote from the first grid electrode $G_1$. Each V-shaped tab 6 has two legs 6a rigidly connected to the sleeve 16. The joined section of the two legs 6a is secured to the cathode mouting pin 5. Therefore, the cathodes K are supported on the cathode base 3.

A metal stay 15 has mounted thereon a cathode base. As will be seen from FIG. 3 and 4, the metal stay 15 has a circumferentially extending section 15 extending essentially along the outer periphery of the cathode base 3, and a flange section 15*b* extending substantially perpendicular to the circumferentially extending section for mating with one plane of the cathode base. This metal stay 15 is fixed to the first grid electrode $G_1$ by laser welding or by any other appropriate method. Therefore, the first grid electrode $G_1$, the cathodes K and the cathode base 3 are constituted into a cathode/-grid pre-assembly 17.

In the cathode/grid pre-assembly 17, a clearance $d_{01}$ between the top of the cathode and plane of the first grid electrode $G_1$ where the electron beam path $h_1$ is defined, is maintained at a predetermined value. This cathode/grid pre-assembly 17 is fixed to the grid holder 13 while maintaining the clearance $d_{12}$ between the first and second grid electrodes $G_1$ and $G_2$ at a predetermined value.

The assembly process of the aforementioned preferred embodiment of the electron gun will be discussed herebelow.

Figure 5:
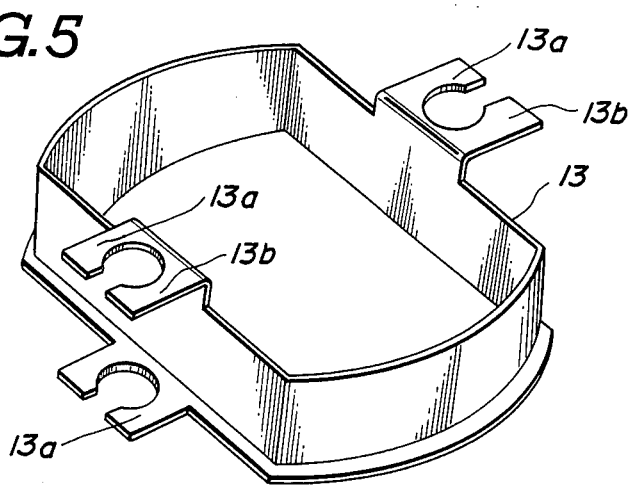
FIG. 5 is a perspective view of a holder in the pre-assembly mounting structure of FIG. 2

As seen from FIG. 5, the grid holder 13 is formed in an essentially cylindrical configuration with mounting pins 13*a* integrally formed therewith. Each of the mounting pins 13*a* has bifurcated legs 13*b* to be buried within the glass beads and extend perpendicularly to the axis of the electron gun from the upper and lower ends of the grid holder 13.

Figure 6:
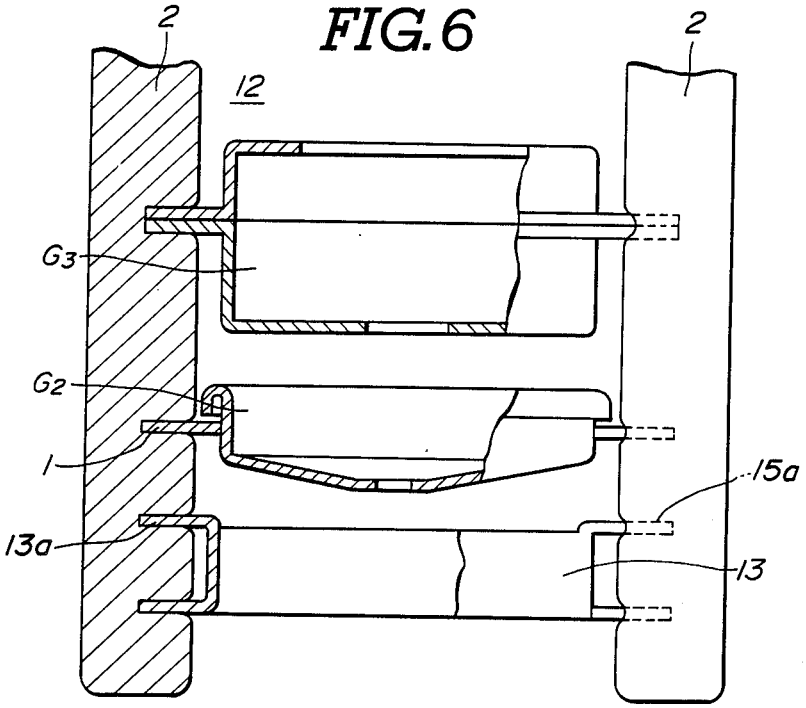
FIG. 6 is a partially sectioned front elevation of a pre-assembly of grid electrodes and bead glass.

The grid holder 13 is arranged in alignment with the second to fifth grid electrodes $G_2$, $G_3$ $G_4$ and $G_5$ leaving respectively predetermined clearances therebetween. The grid holder 13 and the second to fifth grids $G_2$, $G_3$, $G_4$ and $G_5$ are held in place by per se well known manner. In this condition, the glass beads 2 are placed at both sides of the aligned grid holder 13 and the second to fifth grids $G_2$, $G_3$, $G_4$ and $G_5$. Then, beading operation is performed by heating the glass beads 2 and depressing the same toward the grid holder and the second to fifth grid electrodes. As a result, the mount pins 13*a* and 1, 10, 100 and 101 of the grid holder 13 and the second to fifth grids $G_2$, $G_3$, $G_4$ and $G_5$ are buried within the glass beads 2. An assembly 18 of the grid holder 13, the second to fifth grid electrodes $G_2$, $G_3$, $G_4$, and $G_5$ and the glass beads 2 will be in a form as shown in FIG. 6, which assembly will be hereafter referred to as "bead assembly 20".

The cathode/grip pre-assembly 17 is prepared as follows. First, the metal stay 15 is fixed to the cathode base 3 by laser welding. Then, the assembly of the metal stay and the cathode base is inserted into the internal space and fixed in a manner as shown in FIG. 2 by spot welding. After this, the cathodes K are set in the openings 4 and the clearance $d_{01}$ is adjusted by means of the cathode mount pins 5 and the V-shaped tabs 6. In order to precisely adjust the clearance $D_{01}$ between the top of the cathode and the grid electrode plane $H_1$, the airmicrometer is inserted from the side of the first grid electrode $G_1$ through the electron beam path $h_1$. The airmicrometer measures the clearance $d_{01}$. Based on the measured clearance, the cathode position is adjusted so that the clearance $d_{01}$ precisely matches the predetermined value. Therefore, the fixture of the V-shaped tabs 6 to the cathode mounting pins 5 will be performed after adjustment of the cathode/first grid clearance is precisely adjusted.

The cathode/grid pre-assembly 17 is then assembled with the bead assembly 18. During this assembling operation, the clearance $d_{12}$ between the plane $H_1$ of the first grid electrode $G_1$ and the plane $H_2$ of the second grid electrode $G_2$ is adjusted by adjusting the position of the cathode/grid pre-assembly 17 relative to the grid holder. For enabling this adjustment, the distance between the planes $H_1$ and $H_2$ is measured by means of the airmicrometer in a per se well known manner. After completion of precise adjustment of the clearance $d_{12}$ between the first and second grid electrodes $G_1$ and $G_2$, the cathode/grid pre-assembly 17 is rigidly secured to the grid holder 13 by spot welding, such as laser welding.

As will be appreciated, the first grid and cathode can be provided in the form of a pre-assembly with the predetermined clearance $d_{01}$ between the top of the cathode and the plane $H_1$. Since this pre-assembly is formed separately from the grid holder, the pre-assembly is never subjected to forces and heat which would otherwise be exerted during the beading process. In addition, since the position of the first grid electrode can be adjusted after fixing the position of the second grid electrode, precise adjustment of the clearance $d_{12}$ is also possible. Therefore, the process according to the present invention can provide substantially higher yields in production of the electron guns.

While the present invention has been disclosed in terms of the preferred embodiment in order to facilitate better understanding of the invention, it should be appreciated that the invention can be embodied in various ways without departing from the principle of the invention. Therfore, the invention should be understood to include all possible embodiments and modifications to the shown embodiments which can be embodied without departing from the principle of the invention set out in the appended claims.

What is claimed:

1. An electron gun for a cathode ray tube comprising: a plurality of grid electrodes, each defining electron beam paths and having an extension extending substantially perpendicular to an axis of said electron gun, said grid electrodes being arranged so as to align said electron beam paths; a cathode first grid assembly for holding a cathode in alignment with an axis extending through said electron beam paths, and a first grid electrode having a plane through which an electron beam path is defined, said cathode and said first grid electrode of said assembly are oriented to have a predetermined clearance between a top of said cathode and said plane of said first grid electrode; a holder member formed separately from said cathode first grid assembly, said holder member being designed for fixedly mounting said cathode first grid assembly in assembled condition in such a position that said first grid electrode of said assembly is located at a position adjacent one of said grid electrodes with a predetermined distance defined therebetween; a glass bead receiving said extensions of said grid electrodes and said holder member for fixing the positional relationship between said grid electrodes and said holder member, wherein said first grid assembly is prepared as a pre-assembly in advance of being attached to said holder member which is held by said glass bead, and comprises a cathode for generating an electron beam, and a cathode base supporting said cathode with a mounting means, and a metal stay which is fixed to said cathode base, wherein said metal stay is rigidly fixed to said first grid electrode and wherein said holder member is of a generally hollow rectangular configuration having at least two opposite sides with extensions laterally extending from said two opposite sides.

2. An electron gun as set forth in claim 1, wherein said first grid electrode is formed into an essentially cup-shaped configuration and defines therein a space for receiving said cathode base with said cathode.

3. An electron gun for a cathode ray tube comprising: a plurality of grid electrodes, each defining electron beam paths and having an extension extending substantially perpendicular to an axis of said electron gun, said grid electrodes being arranged so as to align said electron beam paths; a cathode first grid assembly for holding a cathode in alignment with an axis extending through said electron beam paths, and a first grid electrode having a plane, through which an electron beam path is defined, said cathode and said first grid electrode of said assembly are oriented to have a predetermined clearance between a top of said cathode and said plane of said first grid electrode; a holder member formed separately from said cathode first grip assembly, said holder member being designed for fixedly mounting said cathode first grid assembly in assembled condition in such a position that said first grid electrode of said assembly is located at a position adjacent one of said grid electrodes with a predetermined distance defined therebetween; a glass bead receiving said extensions of said grid electrodes and said holder member for fixing the positional relationship between said grid electrodes and said holder member, wherein said cathode first grid assembly is prepared as a pre-assembly in advance of being attached to said holder member which is held by said glass bead, and comprises a cathode for generating an electron beam, and a cathode base supporting said cathode with a mounting means, wherein said holder member is of a generally hollow rectangular configuration having at least two opposite sides with extensions laterally extending from said two opposite sides.

* * * * *